United States Patent [19]

Romano

[11] 3,956,949

[45] May 18, 1976

[54] WRENCH WITH QUICK ADJUSTING SLIDING JAW AND SELF TIGHTENING ANVIL JAW

[76] Inventor: Anthony Romano, 6941 Jackson Drive, San Diego, Calif. 92119

[22] Filed: Feb. 18, 1975

[21] Appl. No.: 550,179

Related U.S. Application Data

[63] Continuation of Ser. No. 342,873, March 19, 1973, abandoned.

[52] U.S. Cl. ..... 81/135; 81/180 C

[51] Int. Cl.[2] ..... B25B 13/14

[58] Field of Search ..... 81/100, 102, 135, 136, 81/148, 154, 180 C, 186, DIG. 6

[56] References Cited

UNITED STATES PATENTS

| | | | |
|---|---|---|---|
| 1,125,946 | 1/1915 | Bovee | 81/100 |
| 1,147,181 | 7/1915 | Markovich | 81/136 X |
| 3,280,669 | 10/1966 | Weaver | 81/186 X |

FOREIGN PATENTS OR APPLICATIONS

| | | | |
|---|---|---|---|
| 16,691 | 8/1898 | Switzerland | 81/102 |

*Primary Examiner*—Al Lawrence Smith
*Assistant Examiner*—James G. Smith
*Attorney, Agent, or Firm*—Ralph S. Branscomb

[57] ABSTRACT

A wrench having a body portion with a handle and an inclined sliding jaw, and a movable jaw having a ratchet toothed shank received in a channel in the body portion, and a spring-biased pawl comprising a saddle straddling the shank pivotally mounted on the body of the wrench and carrying a ratchet toothed element which wedges into the channel between the body portion and the shank, engaging the ratchet teeth of the shank to limit separation of the jaws.

4 Claims, 5 Drawing Figures

WRENCH WITH QUICK ADJUSTING SLIDING JAW AND SELF TIGHTENING ANVIL JAW

BACKGROUND OF THE INVENTION

This is a continuation of application Ser. No. 342,873, filed Mar. 19, 1973, now abandoned.

The present invention relates to wrenches, and particularly to Stillson-type wrenches with a quick-adjustment means for varying the jaw spacing.

There are various wrenches in the prior art featuring a quick-adjustment means, often generally referred to as monkey wrenches, but none of these wrenches includes a pawl which may be a ratched-toothed wedge element engaging the toothed shank of the movable jaw with increasing force under increased strain. No other wrench utilizes a sliding inclined jaw to increase the gripping force of the jaws with the application of increased wrenching torque.

SUMMARY OF THE INVENTION

The present invention comprises a wrench having a body portion with a handle and a jaw opposite the handle. A movable jaw has a ratchet-toothed shank which slides within a channel in the body. A pawl is pivotally mounted on the body portion and has a ratchet-toothed element which wedges into that end of the channel away from the jaws between the body portion and the shank such that the ratchet teeth of the shank and pawl mesh together to prevent further separation of the jaws. A spring is used to bias the pawl into locking engagement with the shank. The pawl can be withdrawn with the thumb to release the shank, allowing the jaws to separate. The body portion has an inclined surface on which the jaw is slidably mounted so that as torque is applied to the wrench in use, the sliding jaw increasingly grips the object between the jaws.

DETAILED DESCRIPTION OF THE PREFERRED EMBODIMENT

Figure 1:
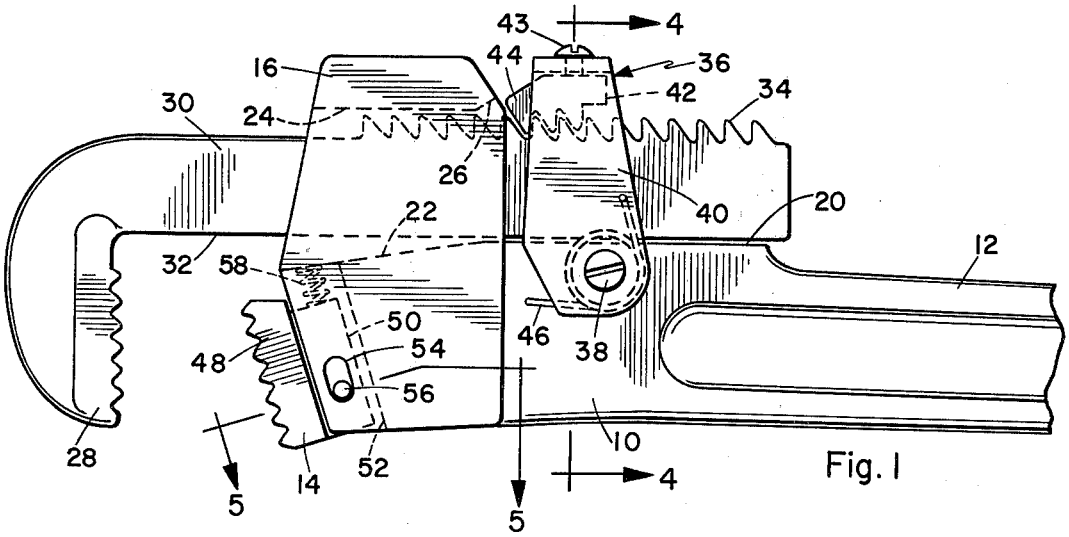
FIG. 1 is a side elevation view of the wrench.
Figure 2:
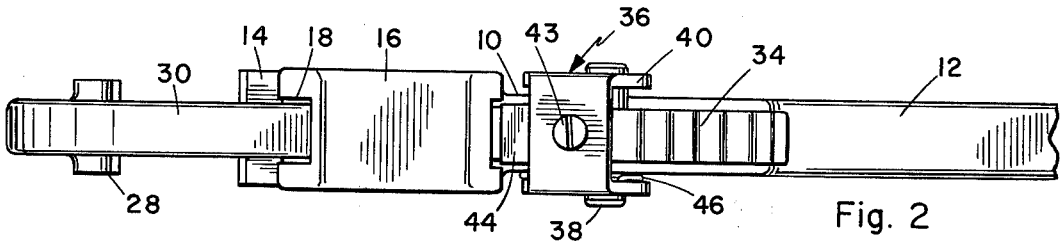
FIG. 2 is a top plan view thereof.

The wrench has a body portion 10 with a handle 12 at one end and a jaw 14 at the other end. The body portion has a rearwardly protruding casing 16 near the jaw with a channel 18 therethrough. The back of the body portion has a flat surface 20 near the casing which merges into a downwardly inclined portion 22 which lies generally within the casing and forms one wall of the channel 18. The opposite wall 24 of the channel is generally parallel to the surface 20 and has an outward bevel 26 at the end of the wall remote from the jaw 14.

A movable jaw 28 has an integrally formed shank 30 which loosely fits within the channel. The shank has a flat side 32, which normally rests on the surface 20, and an opposite side having ratchet teeth 34.

A pawl 36 is pivotally connected to the body of the wrench by a bolt 38 or other suitable means. The pawl consists of a saddle 40 which straddles the shank 30, and a ratchet-toothed element 42 which is carried inside the saddle seat and has a protruding portion 44 which juts beyond the saddle toward the casing 16. The element 42 can be made integrally with the saddle, or it can be a separate piece, removably and replaceably attached by a screw 43 or other suitable means.

A spring means, such as the wirespring 46, biases the pawl against the casing 16. The pawl is positioned and shaped so that under the action of the spring, the protruding portion 44 of the ratchet element seats snugly into the bevel 26 of the channel, and engages the ratchet teeth 34 of the shank to prevent the movable jaw 28 from further separating from the jaw 14.

Figure 3:
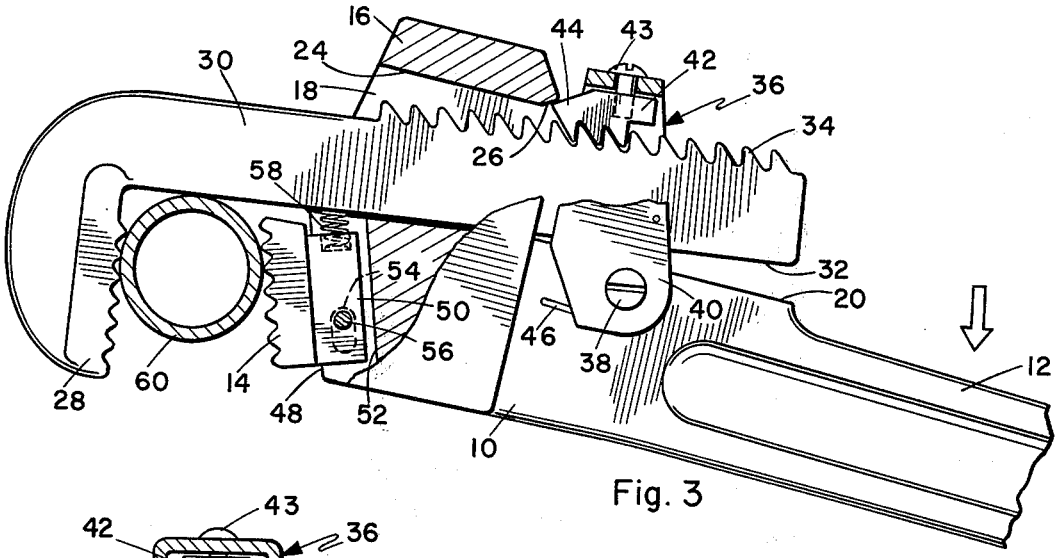
FIG. 3 is a side elevation view, with portions cut away, showing the wrench in use.
Figure 4:
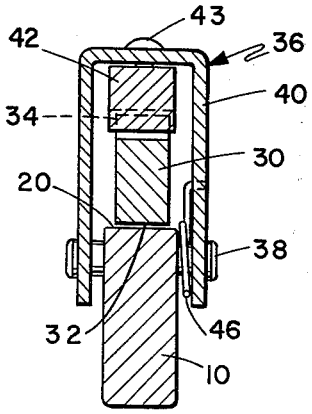
FIG. 4 is a sectional view taken on line 4—4 of FIG. 1.
Figure 5:
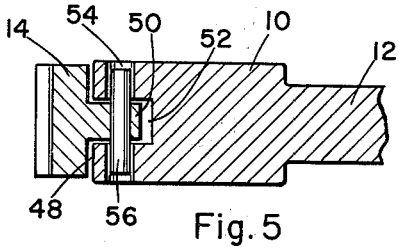
FIG. 5 is a sectional view taken on line 5—5 of FIG. 1.

Although the structure recited above sufficiently defines an operable wrench, the gripping action will be enhanced, as described below, by the incorporation of a slidability feature in the jaw 14. Different methods of making the jaw 14 slidable are conceivable, but in the preferred embodiment the jaw rides on the flat end portion 48 of the body portion which is inclined away from the movable jaw 28 as illustrated in FIGS. 1 and 3.

The jaw 14 has a tongue 50 which slidably seats in a slot 52 and perpendicularly bisects th inclined end portion 48. A second slot 54 extends through the body of the wrench normal to the first slot and is elongated in the direction of the incline of the end portion 48. A pin 56 extends through and is secured to the tongue 50 and rides in the slot 54 so that movement of the jaw 14 is restricted to sliding a limited distance along the inclined end portion 48. A spring 58 biases the jaw away from the body of the wrench.

When the wrench is not in use, as shown best in FIG. 1, the shank 30 lies generally flush against the flat surface 20 and the rear wall 24 of channel 18. The element 42 seats in the bevel 26 such that the ratchet teeth of element 42 engage the shank and a narrow space exists between the saddle 40 and the casing 16. The sliding jaw 14 is in its furthermost position from the shank due to the biasing action of spring 58.

In operation, the pawl 36 is pivoted away from the casing 16 by the thumb of the user or otherwise to release the shank 30. The shank is then extended until the jaws are separated enough to clear the pipe 60 or other object to be turned, and the pawl is released. The jaws are then manually closed around the pipe until they grip the pipe as snugly as the ratchet mechanism will allow, and pressure is then applied against the handle in the forward direction.

As the force on the handle increases, a twisting action is exerted on the jaws by the resisting pipe so that the movable jaw 28 will move forwardly until the shank 30 rests on the declined portion 22 of the wrench. As the jaw moves, the distance between the jaws decreases, increasing the grip on the pipe, typical of a Stillson wrench. In addition, ratchet-toothed element 42 moves further into the bevel 26 so that the ratchet teeth of element 42 assume an angle identical to the altered angle of the shand, allowing the respective teeth to mesh perfectly.

As the force on the handle 12 is further increased, the counter torque produced by the pipe causes the slidable jaw 14 to slide toward the shank 30 and thus closer to the other jaw, causing the jaws to grip more and more tightly as twisting force is increased.

After use, the wrench is reverse-rotated. This releases the tension on the jaw 14, which slides back to its original position due to the action of the spring 58. The movable jaw returns to its original position, and all tension on the wrench is released. The wrench can now be removed from the pipe, and the pawl is again freely releasable by a stroke of the thumb.

I claim:

1. A wrench comprising:

a. a body portion with a first jaw thereon;

b. said body portion having a channel therein and a handle portion;

c. a movable jaw having a shank loosely received in said channel and said shank having ratchet teeth on a side thereof remote from said jaws, said shank holding the movable jaw in opposed relation to said first jaw;

d. a pawl having a forward face with a plurality of teeth thereon complementing said ratchet teeth and having a generally smooth rear face, said pawl being pivotally mounted on said body portion and being capable of pivoting from a position clear of the ratchet teeth on said shank to a wedged position in which said rear face abuts a portion of said body portion remote from said jaws and the teeth on said forward face engage the ratchet teeth on said shank, such that said pawl is compressed between a portion of said body portion remote from said jaws and said shank as said jaws are separated, thus locking the shank in adjusted position against movement in one direction in said channel.

2. A wrench comprising:

a. a body portion with a first jaw thereon;

b. said body portion having a channel therein and a handle portion;

c. a movable jaw having a shank loosely received in said channel and said shank having ratchet teeth on a side thereof remote from said jaws, said shank holding the movable jaw in opposed relation to said first jaw;

d. A saddle pivotally mounted on said body portion and straddling said shank and having a pawl mounted thereon which is capable of pivoting with said saddle from a position clear of the ratchet teeth on said shank to a wedged position between a portion of said body portion remote from said jaws and the ratchet teeth on said shank, thus locking the shank in adjusted position against movement in one direction in said channel.

3. A wrench according to claim 2 wherein said saddle is spring biased to move toward said portion of said body and toward a wedging relationship between said body and the ratchet teeth on said shank.

4. A wrench according to claim 2 wherein said pawl includes a ratchet toothed element and is removably and replaceably secured in said saddle.

* * * * *